US009480108B2

(12) United States Patent
Pi

(10) Patent No.: US 9,480,108 B2
(45) Date of Patent: Oct. 25, 2016

(54) SOLID-STATE LIGHT SOURCE

(71) Applicant: Axlen, Inc., Wilmington, DE (US)

(72) Inventor: Bo Pi, Carlsbad, CA (US)

(73) Assignee: AXLEN, INC., Wilmington, DE (US)

( * ) Notice: Subject to any disclaimer, the term of this patent is extended or adjusted under 35 U.S.C. 154(b) by 159 days.

(21) Appl. No.: 13/865,930

(22) Filed: Apr. 18, 2013

(65) Prior Publication Data

US 2013/0278153 A1 Oct. 24, 2013

Related U.S. Application Data

(60) Provisional application No. 61/635,213, filed on Apr. 18, 2012.

(51) Int. Cl.
*H05B 33/08* (2006.01)

(52) U.S. Cl.
CPC ..... *H05B 33/08* (2013.01); *H05B 33/083* (2013.01); *H05B 33/086* (2013.01); *H05B 33/0869* (2013.01)

(58) Field of Classification Search
CPC ..... H05B 33/083; H05B 33/086; H05B 33/0869
USPC ..... 315/185 R, 291, 307
See application file for complete search history.

(56) References Cited

U.S. PATENT DOCUMENTS

| | | | | |
|---|---|---|---|---|
| 7,317,403 | B2 * | 1/2008 | Grootes et al. | 340/815.45 |
| 7,560,677 | B2 * | 7/2009 | Lyons et al. | 250/205 |
| 7,649,326 | B2 * | 1/2010 | Johnson et al. | 315/291 |
| 7,688,002 | B2 * | 3/2010 | Ashdown et al. | 315/291 |
| 8,552,663 | B2 * | 10/2013 | Welten | 315/307 |
| 8,643,308 | B2 * | 2/2014 | Grajcar | 315/307 |
| 8,665,188 | B2 * | 3/2014 | Yun | 345/77 |
| 8,896,229 | B2 * | 11/2014 | Lys et al. | 315/291 |
| 8,917,026 | B2 * | 12/2014 | Ferrier | 315/192 |
| 2006/0176411 | A1 | 8/2006 | Furukawa | |
| 2010/0026191 | A1 | 2/2010 | Radermacher et al. | |
| 2010/0060175 | A1 * | 3/2010 | Lethellier | 315/164 |
| 2010/0315016 | A1 * | 12/2010 | Hoogzaad | 315/224 |
| 2011/0309757 | A1 | 12/2011 | Weaver et al. | |
| 2012/0104953 | A1 * | 5/2012 | Chobot | 315/153 |

FOREIGN PATENT DOCUMENTS

| | | | |
|---|---|---|---|
| WO | 2010103480 | A2 | 9/2010 |
| WO | 2011027299 | A2 | 3/2011 |

OTHER PUBLICATIONS

Lee, D. Y., Authorized Officer, Korean Intellectual Property Office, International Search Report and Written Opinion, International Application No. PCT/US2013/037237, Jul. 30, 2013, 12 pages.

* cited by examiner

*Primary Examiner* — Kenneth B Wells
(74) *Attorney, Agent, or Firm* — Perkins Coie LLP

(57) ABSTRACT

In one aspect, a light source module includes one or more light emitters of a first color forming a first color group, one or more light emitters of a second color forming a second color group, the one or more light emitters of the second color group connected in series to the one or more light emitters of the first color group, a second color group adjustment circuit connected in parallel to the one or more light emitters of the second color group, the second color group adjustment circuit configured to adjust one or both of color and intensity of output light of the second color group, and a current source connected in series to solid-state color emitters of the first and the second color groups.

20 Claims, 8 Drawing Sheets

SOLID-STATE LIGHT SOURCE

PRIORITY CLAIM

This patent document claims the priority and benefit of U.S. provisional application No. 61/635,213 entitled "SOLID STATE LIGHT SOURCE", filed on Apr. 18, 2012, the entire disclosure of which is incorporated herein by reference for all purposes.

TECHNICAL FIELD

This patent document relates to systems, devices, and processes for using light-emitting diodes in lighting devices or lighting fixtures.

BACKGROUND

Lighting devices can be constructed by using a plurality of light sources such as light-emitting diodes or a laser diodes.

A light-emitting diode (LED) is a semiconductor light source. An LED includes semiconducting materials doped with impurities to create a p-n junction, in which electrical current can easily flow one directionally from the p-side (anode) to the n-side (cathode), but not in the reverse direction. Charge-carriers (e.g., electrons and holes) flow into the p-n junction from connecting electrodes at each end of the junction having different voltages. For example, when an electron combines with a hole, the electron falls into a lower energy level and can release energy in the form of a photon, e.g., emitting light. This effect is referred to as electroluminescence. The wavelength of the light emitted, and thus the color of the emitted light, depends on the band gap energy of the materials forming the p-n junction. For example, bright blue LEDs are based on the wide band gap semiconductors including GaN (gallium nitride) and InGaN (indium gallium nitride). LED devices can be used to emit white light that are energy-efficient alternative light sources for replacing some conventional light sources such as incandescent light bulbs and florescent lights. For producing white light using LEDs, one technique is to use individual LEDs that emit three primary colors (red, green, and blue) and then mix all the colors to form white light. Another technique is to use a phosphor material to convert monochromatic light from a blue or ultraviolet LED to broad-spectrum white light, e.g., in a similar manner to fluorescent light bulbs.

A laser diode (LD) is an electrically-pumped semiconductor laser light source. In an LD, the active medium is a solid-state semiconductor formed by a p-n junction, e.g., similar to that found in an LED, rather than a gas medium (e.g., in conventional lasing). Laser diodes form a subset of semiconductor p-n junction diodes. For example, a forward electrical bias across the p-n junction of the LD causes the charge carriers to be injected from opposite sides of the p-n junction into the depletion or junction region, e.g., holes are injected from the p-doped component and electrons are injected from the n-doped component of the semiconductor material. As electrons are injected into the diode, the charge carriers combine, some of their excess energy is converted into photons, which interact with more incoming electrons, thereby producing more photons in a self-perpetuating analogous to the process of stimulated emission that occurs in a conventional, gas-based laser. Some examples of conventional LDs include 405 nm InGaN blue-violet laser diodes, e.g., used in in Blu-ray Disc and high definition DVD drive technologies, and 785 nm GaAlAs (gallium aluminum arsenide) laser diodes, e.g., used in Compact Disc (CD) drives.

SUMMARY

Techniques, systems, and devices are disclosed for producing colored light using solid-state lighting sources.

In one aspect of the disclosed technology, a light source module includes one or more light emitters of a first color forming a first color group, one or more light emitters of a second color forming a second color group, the one or more light emitters of the second color group connected in series to the one or more light emitters of the first color group, a second color group adjustment circuit connected in parallel to the one or more light emitters of the second color group, the second color group adjustment circuit configured to adjust one or both of color and intensity of output light of the second color group, and a current source connected in series to solid-state color emitters of the first and the second color groups.

Implementations of the light source module can optionally include one or more of the following features. For example, the one or more light emitters of the first color and second color can be light-emitting diodes and/or laser diodes. For example, the first color group can be configured as a yellow color group and the second color group can be configured as a red color group or a blue color group. In some implementations, for example, the light source module can further include one or more light emitters of a third color forming a third color group, the one or more light emitters of the third color group connected in series to the one or more light emitters of the second color group, and a third color group adjustment circuit connected in parallel to the one or more light emitters of the third color group, the third color group adjustment circuit configured to adjust one or both of color and intensity of output light of the third color group. For example, the first color group can be configured as a yellow color group, the second color group can be configured as a red color group, and the third color group can be configured as a blue color group. In some implementations, for example, the second color adjustment circuit can be configured to adjust the current that flows through the one or more light emitters of the second color group and the current that flows through the one or more light emitters of the third color group. In other implementations, for example, the second color adjustment circuit can be configured to adjust the current that flows through the one or more light emitters of the second color group, and the third color adjustment circuit can be configured to adjust the current that flows through the one or more light emitters of the third color group. In some implementations, for example, the second color adjustment circuit can include a feedback mechanism to control a ratio of the current that flows through the one or more light emitters of the second color group to the current that flows through the second color adjustment circuit. Also for example, the third color adjustment circuit can include a feedback mechanism to control a ratio of the current that flows through the one or more light emitters of the third color group to the current that flows through the third color adjustment circuit. In some implementations, for example, at least one of the second color adjustment circuit or the third color adjustment circuit can include a programmable module to provide a current sink, in which the programmable module includes an analog-to-digital converter to convert an analog signal associated with the current to a digital signal, a programmable microcontroller or CPU to process data corresponding to the digital signal to determine an adjusted current to flow through the one or more light emitters of the corresponding color group, a memory unit coupled to the programmable microcontroller or CPU to store at least one of processing algorithms or look-up table data, and one or both of a digital-to-analog converter and a pulse width modulation output component to provide the adjusted current. In some implementations, for example, at least one of the second color adjustment circuit or the third color adjustment circuit can include one or more sensors configured to sense one or more of temperature, color value or intensity of light emitted by the corresponding color group.

In another aspect, a method for producing a light of a particular color at the output of a light source module includes a process to provide a current flow through a series of light emitters, in which the series of light emitters includes one or more light emitters of a first color and one or more light emitters of a second color, and a process to adjust current flow through the light emitters of the second color such that a combined light output of all light emitters of the first color and the second color has a particular color characteristic.

Implementations of the method can optionally include one or more of the following features. For example, the particular color characteristic can include one or more of a particular color index, a range of color values in a CIE color space, a color intensity value, or a color temperature value. For example, the process to adjust the current flow can be carried out by one or more iterations of measuring light output of the light source module, and adjusting the current flow through a second color adjustment circuit that is connected in parallel to the light emitters of the second color. For example, the series of light emitters can include one or more additional light emitters corresponding to one or more additional colors, in which a particular color characteristic associated with all light emitters of the first color, the second color, and the additional colors can be obtained by additionally adjusting current flow through the one or more additional light emitters.

BRIEF DESCRIPTION OF THE DRAWINGS

Like reference symbols and designations in the various drawings indicate like elements.

DETAILED DESCRIPTION

Figure 1:
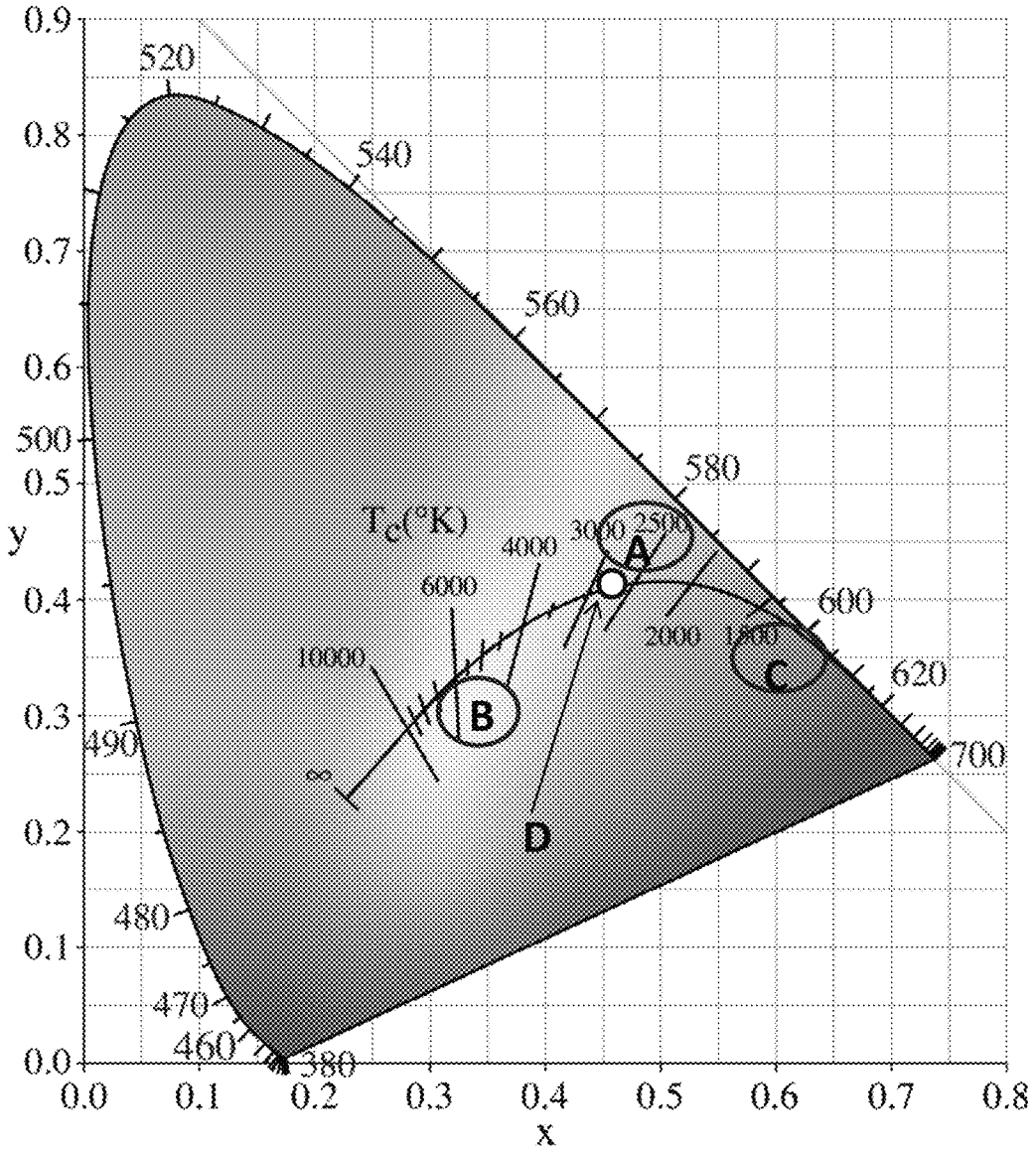
FIG. 1 shows an exemplary CIE color space chart including the black body curve.

The techniques, designs, and examples described in this document are directed to and applicable to energy-efficient lighting devices based on solid-state lighting devices such as semiconductor light-emitting diodes (LEDs), semiconductor laser diodes (LDs) and other light-emitting structures. The exemplary techniques, systems, devices, and designs described herein use LEDs as examples and can be applicable to lighting devices based on LDs or other solid-state light-emitting structures.

In some existing LED light sources, the color of the light source is determined by the phosphor that is applied to the LED light emitter source and/or by mixing different colors of light together. However, the process of applying the phosphor can be difficult to control, and the LED output of different color LEDs can be sensitive to temperature in a non-uniform manner. For example, the temperature sensitivity of a blue LED can different from that of a red LED. For at least this reason, it can be difficult to make the output of each LED light source color uniform.

An LED light has a certain light spectrum output. For example, by combining multiple LEDs in an LED lighting device, a variety of color outputs can be produced that make up the light spectrum of the LED lighting device, e.g. such as by using LED lights that emit light of different colors. Such LED lights that can emit light of different colors can be LEDs combined with different phosphor materials, in which the phosphor materials emit light of different color under optical excitation of the LED light, or can be LEDs based on semiconductor materials that emit light of different colors. However, due to the production variation of LED chips and/or differences in phosphor performance, an LED light spectrum of a single color may have variations from one LED light to another. Also, the LED light spectrum of a single color may also change over time due to aging and other time-dependent factors. Additionally, for example, by changing the driving current through LEDs, different intensity of light outputs can be produced. The LED intensity also may change over temperature and time. These effects may cause the combined light output to color shift and produce significant output color and intensity variability between production units that are intended to produce the same color/intensity light output.

Techniques, systems, and devices are disclosed for producing light with reliant color and intensity output using solid-state lighting sources.

Another challenge for solid-state illumination sources, such as LED illumination sources, is the color reproduction capability as measured, for example, according to a standardized metric, such as measured color rendering index (CRI). For example, for typical LED light sources, the associated CRI is lower than traditional light sources, such as incandescent lamps or Xenon lamps, which have a CRI equal or better than 95 since their photons are generated from a blackbody radiation process. In contrast, most common white LEDs that comprise luminescent material (e.g., such as YAG based phosphors) on blue LEDs produce a white color output near blackbody locus with a CRI of around 80 due to, for example, low optical output at red and green spectral range of typical luminescent materials.

Some of the disclosed embodiments described in this patent document can be used to address this challenge by utilizing multiple light source color groups within a light source module that can be adjusted to collectively produce a high CRI output.

FIG. 1 shows an exemplary CIE color reproduction chart showing the x and y chromaticity coordinates and the black body curve. For example, in a typical LED light source design, one would like the output to be on the black body source color line, with a typical equivalent color temperature between 2700 K to 6000 K. For example, to make an LED light source output on the black body line and near the 2700 K, blue light which can be produced by a blue light source (illustrated in FIG. 1 by the circle labeled B) can be mixed with red light which can be produced by a red light source (illustrated in FIG. 1 by the circle around the letter C), and in addition mixed with yellow light, e.g., which can be produced by application of phosphor to a blue LED (illustrated in FIG. 1 by the circle around the letter A). To achieve an output near the black body line and at 2700 K, the yellow source provides the majority of the contribution to the light output, the red source contributes a lesser amount, while the blue source contributes the least amount of contribution from the three light sources.

In one aspect, a light source module includes one or more light emitters of a first color forming a first color group, one or more light emitters of a second color forming a second color group, the one or more light emitters of the second color group connected in series to the one or more light emitters of the first color group, a second color group adjustment circuit connected in parallel to the one or more light emitters of the second color group, the second color group adjustment circuit configured to adjust one or both of color and intensity of output light of the second color group, and a current source connected in series to solid-state color emitters of the first and the second color groups.

Figure 2:
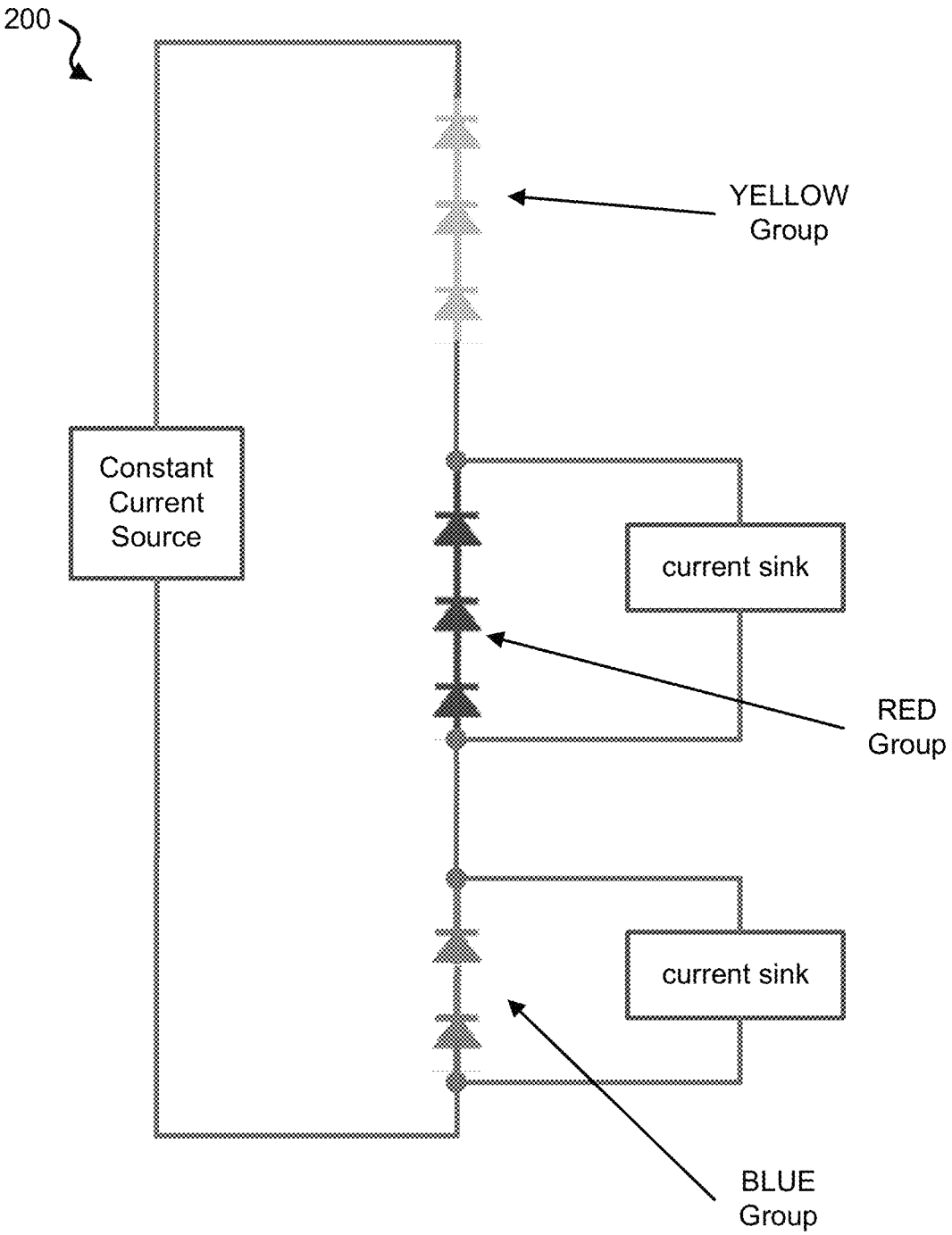
FIG. 2 shows a diagram of an exemplary light source module including multiple solid-state light emitters that are used to produce a combined light output of a particular color and/or intensity.

FIG. 2 shows a diagram of an exemplary light source module 200 including multiple solid-state light emitters that are used to produce a combined light output of a particular color and/or intensity. The light source module 200 includes multiple LEDs including two blue LEDs forming a blue color group of light emitters, three red LEDs forming a red color group of light emitters, and three yellow LEDs forming a yellow color group of light emitters, in which the color groups are connected in series. It is noted that the exemplary configuration of FIG. 2, the light source module 200 can include any number of LEDs (e.g., one or more LEDs) within two or more color groups. For example, in some embodiments of the light source module, only yellow and red LED color groups may be utilized.

In the exemplary configuration of the light source module 200 shown in FIG. 2, all of the LEDs are connected in series so that one current source can drive the string of LEDs. To control the relative intensity of each color group, one or more parallel current paths can be implemented for one or more color groups to independently control the intensity and/or color contribution of each color group. In the example embodiment shown in FIG. 2, the light source module 200 includes parallel current paths for the blue and red color groups. Each parallel current path can include a current sink that enables the adjustment of current flow (and therefore light output) of the associated color group, as well as the adjustment of the light output of one color group with respect to other color groups. In some exemplary embodiments, for example, the current sink is a programmable current sink.

In the exemplary case in which the light source module 200 includes yellow, blue, and red LEDs to produce a white warm white light source (e.g., at 2700 K), the dominant light energy comes from the yellow color group, and a smaller amount red light and even a smaller amount of blue light is required. In one particular example, the proportional contribution of yellow, blue, and red light sources can be configured as 57%, 33% and 10%, respectively. For example, when the yellow LED is produced by applying a phosphor to a blue LED (or a UV LED), the non-uniformity of color output associated with the yellow LED can be compensated by adjusting the light output of the blue and red LEDs. As a result, the combined light output color and intensity of the light source module 200 including the plurality of color groups can be accurately controlled. The exemplary light source module 200, therefore, provides a flexible mechanism for adjusting the output light intensity and/or color of the light module.

Figure 3:
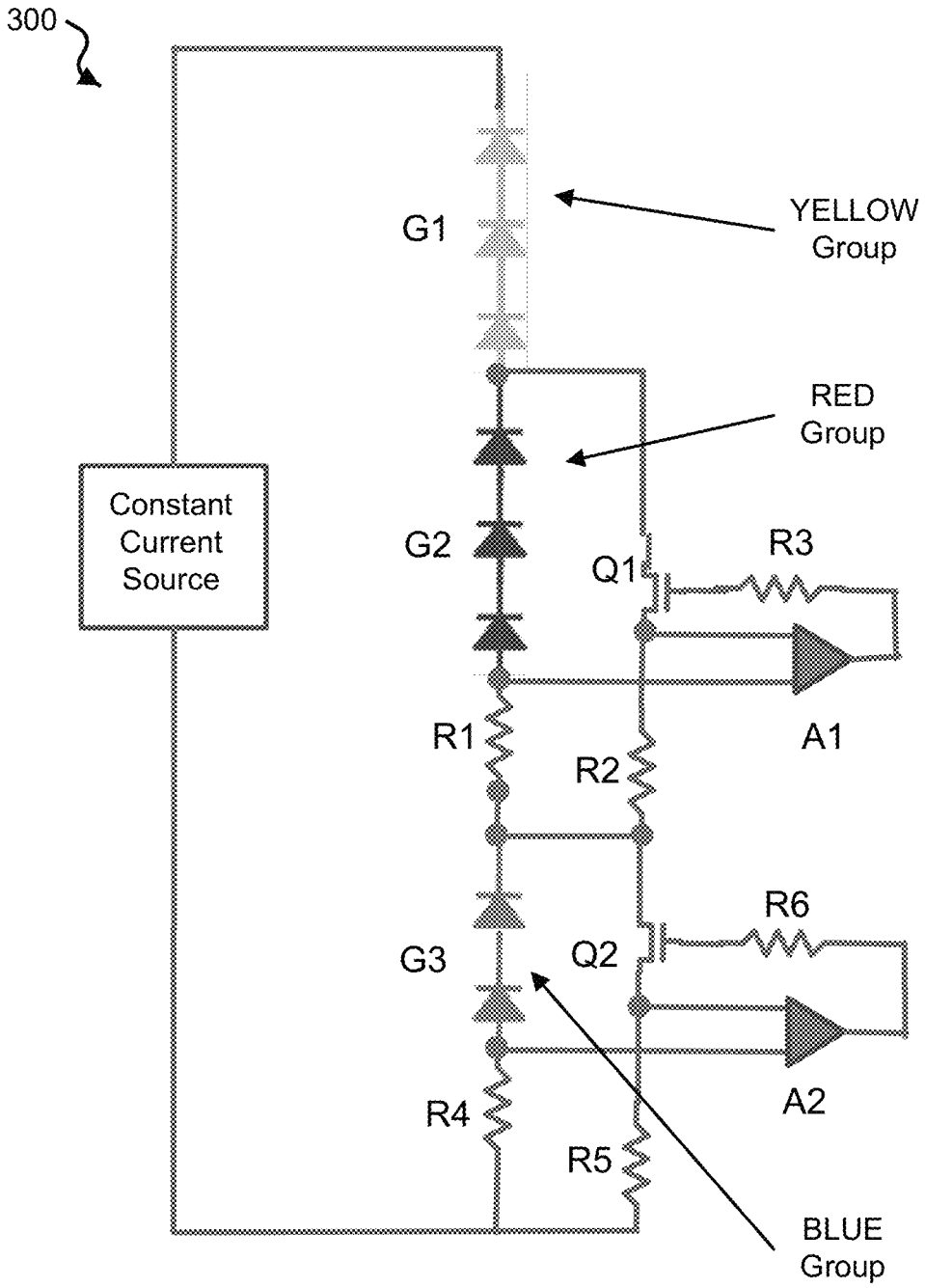
FIG. 3 shows a diagram of another exemplary light source module of the disclosed technology.

FIG. 3 shows a diagram of another exemplary embodiment of the light source module. In FIG. 3, a light source module 300 includes a similar configuration to that of the light source module 200, but with some modifications. The light module 300 is configured such that the current that flows through the red LED color group and the current that flow through the parallel path associated with the red LED color group are sensed by two sensing resistors R1 and R2. The current differences are amplified by amplifier A1, and this signal is fed back through feedback resistor R3 to control the parallel path current using transistor Q1. This exemplary feedback configuration of the parallel path in FIG. 3 provides a linear feedback mechanism and is designed to ensure that the relative currents (e.g., the ratio of the currents) that flow through the red LED path and the associated parallel path are kept constant, and thus are not sensitive to changes in the total current changes in the main path (e.g., such as fluctuations in the supply output current). Such fluctuations can occur due to, for example, dimming or brightening of the light module output 300.

In some implementations, for example, the ratio of the red LED path current and parallel path current can be adjusted by trimming the sensing resistor R1 and R2. This can be performed using, for example, laser trimming during manufacturing and/or calibration procedures and while the LED module is turned on under a measurement system. As such, the sensing resistors can be actively trimmed based on the intensity and/or color value feedback produced by the measurement system.

FIG. 3 also depicts a similar example of parallel path components associated with the blue color group that includes sensing resistors R4 and R5, amplifier A2, feedback resistor R6 and transistor Q2. The values of the components associated with the blue color group parallel path can be determined and adjusted according to a similar technique that was described in connection with the red color group.

Figure 4:
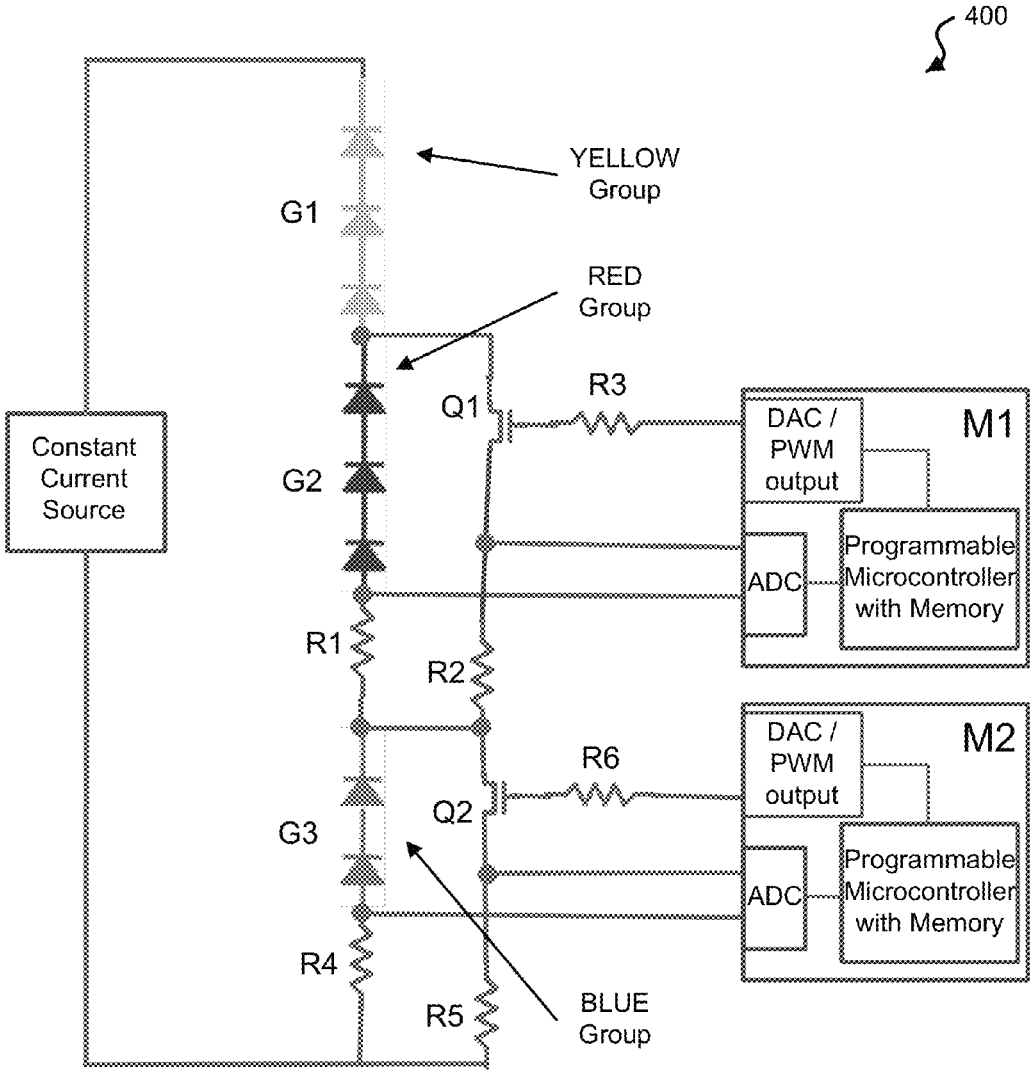
FIG. 4 shows a diagram of another exemplary light source module of the disclosed technology.

FIG. 4 shows a diagram of another exemplary embodiment of the light source module. In FIG. 4, a light source module 400 includes a similar configuration to that of the light source module 300, with some modifications. The current associated with the red LED color group and the current that flow through the associated parallel path are still sensed by two the sensing resistors R1 and R2. The light module 400 is configured such that the current differences are fed to a programmable module M1 to provide a current sink functionality for the red color group. The programmable module M1 includes an analog-to-digital converter (ADC), a programmable microcontroller or CPU with a memory unit (e.g., which may or may not be a part of the microcontroller), and a digital-to-analog converter (DAC) and/or a pulse width modulation (PWM) output component. The exemplary CPU can be configured to, based on the signal that it receives through the ADC, calculate an output to control the parallel path current through a DAC or PWM type output port. The calculation of the output values can be done according to a predetermined algorithm or through a lookup table. Such an algorithm or lookup table can, for example, specify values that are needed to produce the appropriate current flowing through the parallel path for producing a particular RED light output intensity and/or color.

FIG. 4 also depicts a similar example of a programmable module M2 that can be utilized to provide the intelligent current sink functionality for the blue color group. The programmable module M2 includes an ADC, a programmable microcontroller or CPU with a memory unit (e.g., which may or may not be a part of the microcontroller), and a DAC and/or a PWM output component. Alternatively, in some implementations, for example, instead of implementing a separate module M2, the module M1 may be configured to also receive the sensed values for the blue color group and produce the appropriate feedback values for the blue color group.

Figure 5:
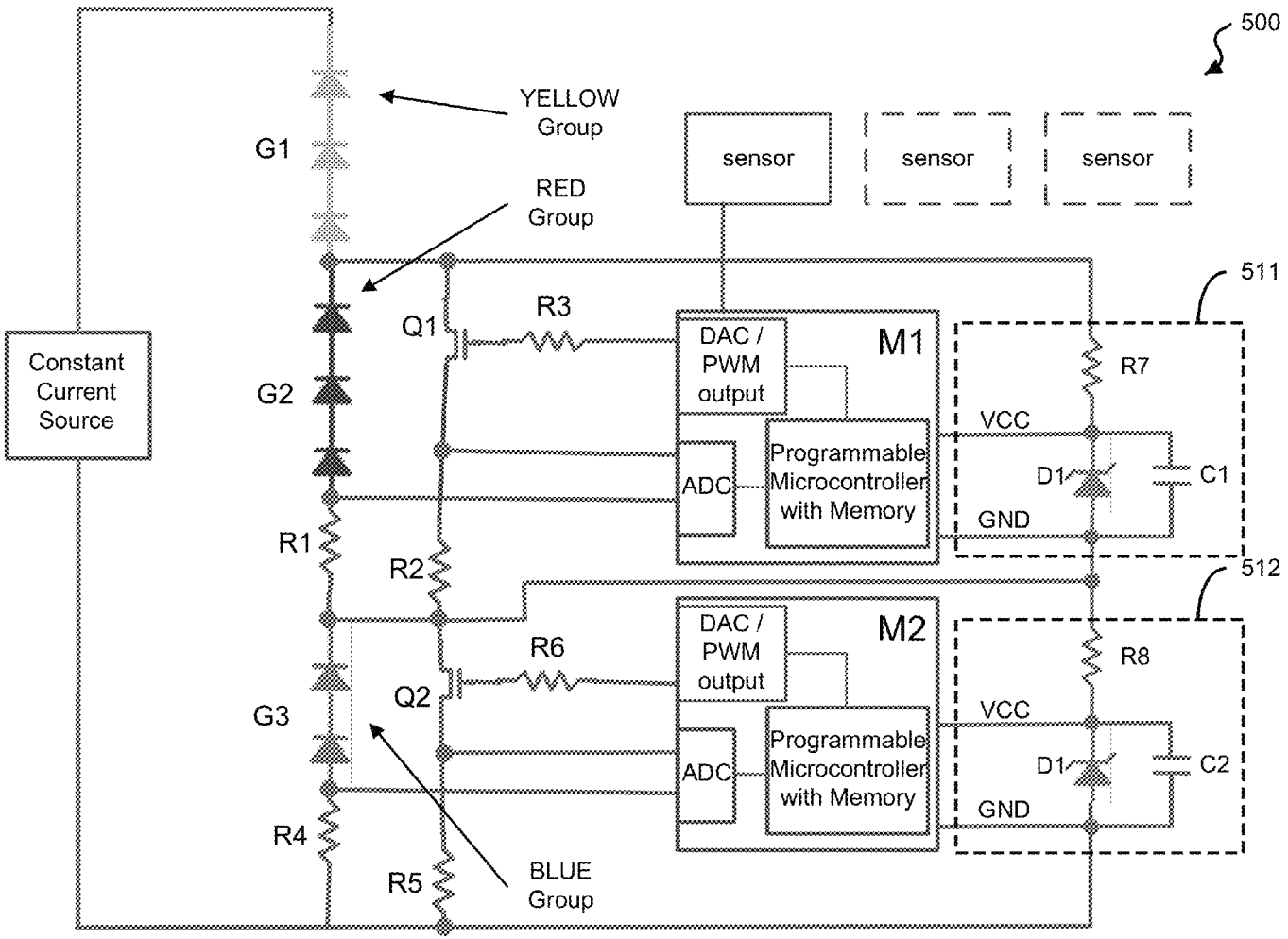
FIG. 5 shows a diagram of another exemplary light source module of the disclosed technology.

FIG. 5 shows a diagram of another exemplary embodiment of the light source module. In FIG. 5, a light source module 500 includes a similar configuration to that of the light source module 400, with some modifications. The light source module 500 can be configured such that one or both of the programmable modules M1 and M2, e.g., including the associated microcontrollers or CPU, operate using the power supplied by the LED drive current sources. For example, the light source module 500 can include power supply circuits 511 and 512 that supply voltages VCC to the programmable modules M1 and M2 that control the operations of the LED groups G1, G2 and G3 of different colors.

In addition, as shown in FIG. 5, the light source module 500 can include one or more sensors connected to the microcontroller or the CPU of one or both of the programmable modules M1 and M2 to allow various measured values to be provided to the microcontroller/CPU. For example, the sensors can be temperature, color value, and/or intensity of light sensors. In the exemplary case of temperature sensing, the measured temperature can be used to adjust the feedback current to compensate for temperature effects on the LED output. For example, a red LED usually has a higher temperature coefficient than a blue LED. If the exemplary yellow LED is made using the blue LED and corresponding phosphor material, then the yellow and blue LED outputs can have the same variations as a function of temperature. So, for example, when the measured temperature associated with the red LED group is higher due to, for example, the environment or local hearing of the LED group, the current of the parallel path can be reduced, thereby increasing the red LED path current.

Figure 6:
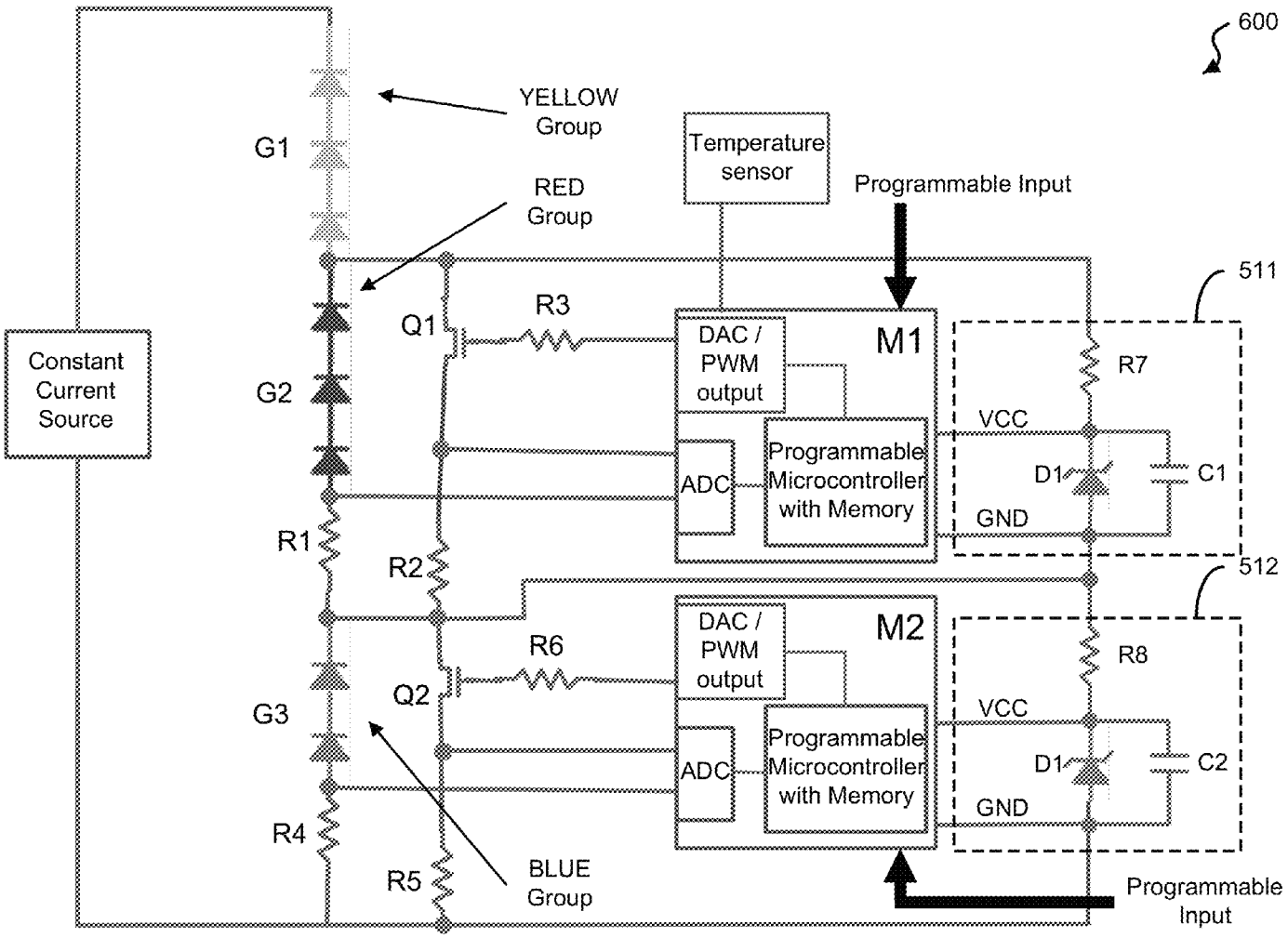
FIG. 6 shows a diagram of another exemplary light source module of the disclosed technology.

FIG. 6 shows a diagram of another exemplary embodiment of the light source module. In FIG. 6, a light source module 600 includes a similar configuration to that of the light source module 500, with some modifications. The light source module 600 can include an interface port to provide connectivity to the programmable modules M1 and M2 (and the associated microcontroller/CPU) so as to provide the capability to provide data, signaling information, as well as program code that can be stored in the memory of the modules M1 and M2.

In one example, the microcontroller/CPU is preprogrammed with a predetermined algorithm, coefficients and/or a particular look up table values. After the light module is assembled, and, for example, as part of final testing and tuning procedures, the measurement system can measure the light output of the light sources, determine the intensity and color position of the light source, and adjust the red and/or blue LED groups' intensity by providing the appropriate values, algorithms or coefficients to the microcontroller/CPU. The measurement and adjustment operations can be performed in several iterations until the desired output intensity/color is obtained. The final coefficients (or other values) can be stored in the nonvolatile memory of the microcontroller/CPU, and the light module should be able to power up and operate at the correct color position and intensity all the time. Using the exemplary configuration of the light source module 600, each light module that is subjected to such testing and measurement procedures can be provided with a different set of coefficients that enable the light module to produce an output intensity and/or color position that is substantially the same as another light module.

In another aspect, a method for producing a light of a particular color at the output of a light source module includes providing a current flow through a series of light emitters, in which the series of light emitters includes one or more light emitters of a first color and one or more light emitters of a second color, and adjusting current flow through the light emitters of the second color such that a combined light output of all light emitters of the first color and the second color has a particular color characteristic.

Figure 7:
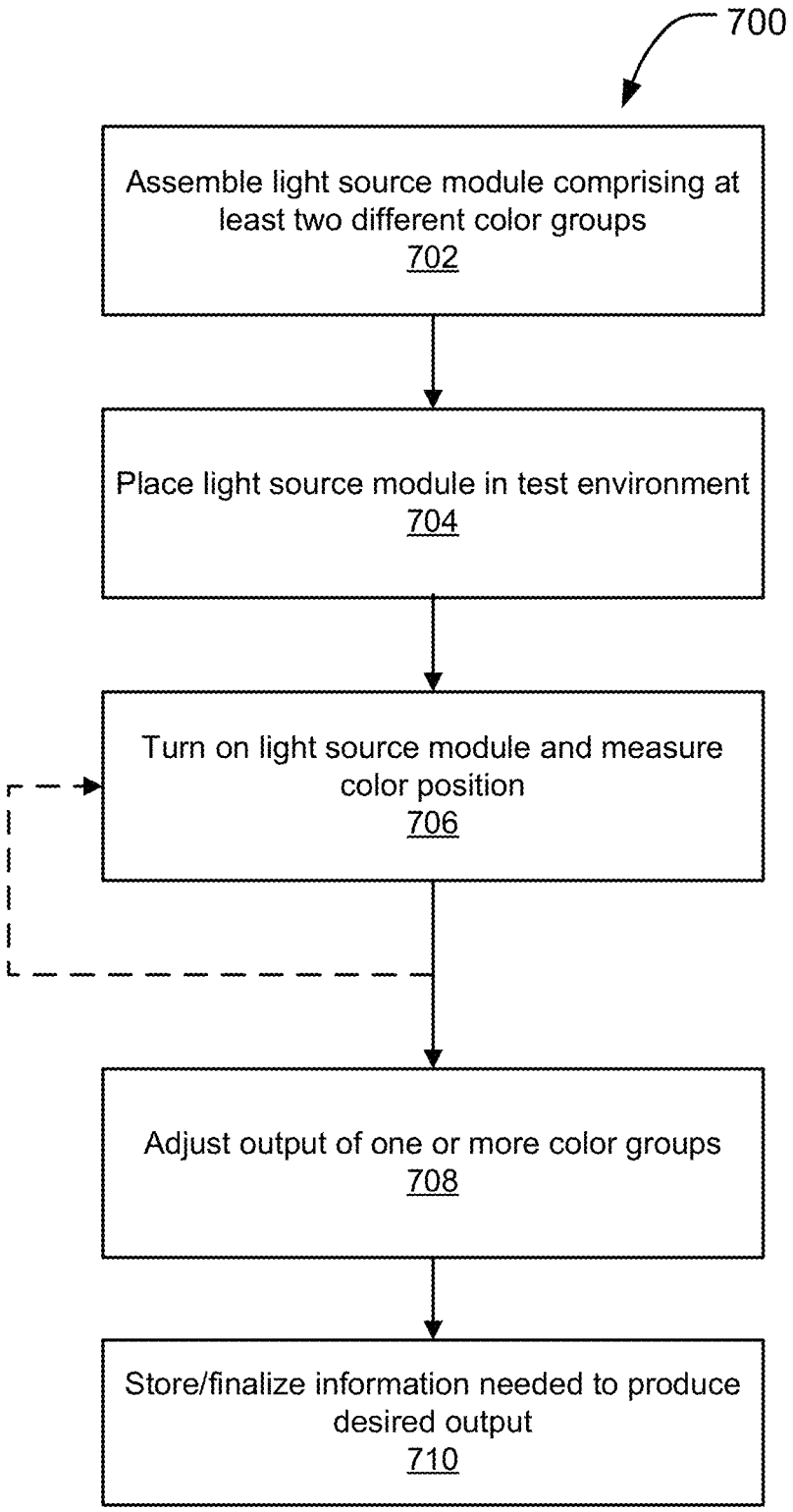
FIG. 7 shows a process diagram of a set of exemplary operations to adjust the light output intensity and/or color of an exemplary light source module.

FIG. 7 shows a process diagram 700 of a set of exemplary operations to adjust the light output intensity and/or color of an exemplary light source module. The process includes an operation 702 to assemble a light source module including at least two color groups. For example, such a light source module can be any one of exemplary light source configurations that is illustrated in FIGS. 2-6. The process includes an operation 704 to place the assembled light source module in a test environment. For example, such a test environment can enable the testing and/or measurement of the output produced by the light module at different temperatures or other environmental conditions. The process includes an operation 706 to turn on the light source module and measure the color and/or intensity values of each of the color groups. The process includes an operation 708, based on the measured color position and/or intensity value, to adjust the current in the parallel path of each color group (if needed) to produce the desired output color temperature and/or intensity. The operation steps 706 and 708 can be repeated several times to achieve the desired outcome. The process includes an operation 708 to store and/or finalize, e.g., in memory, the information needed to produce the desired light output. For example, certain final parameters can be stored in a non-volatile memory associated with each parallel path of a color group.

Figure 8:
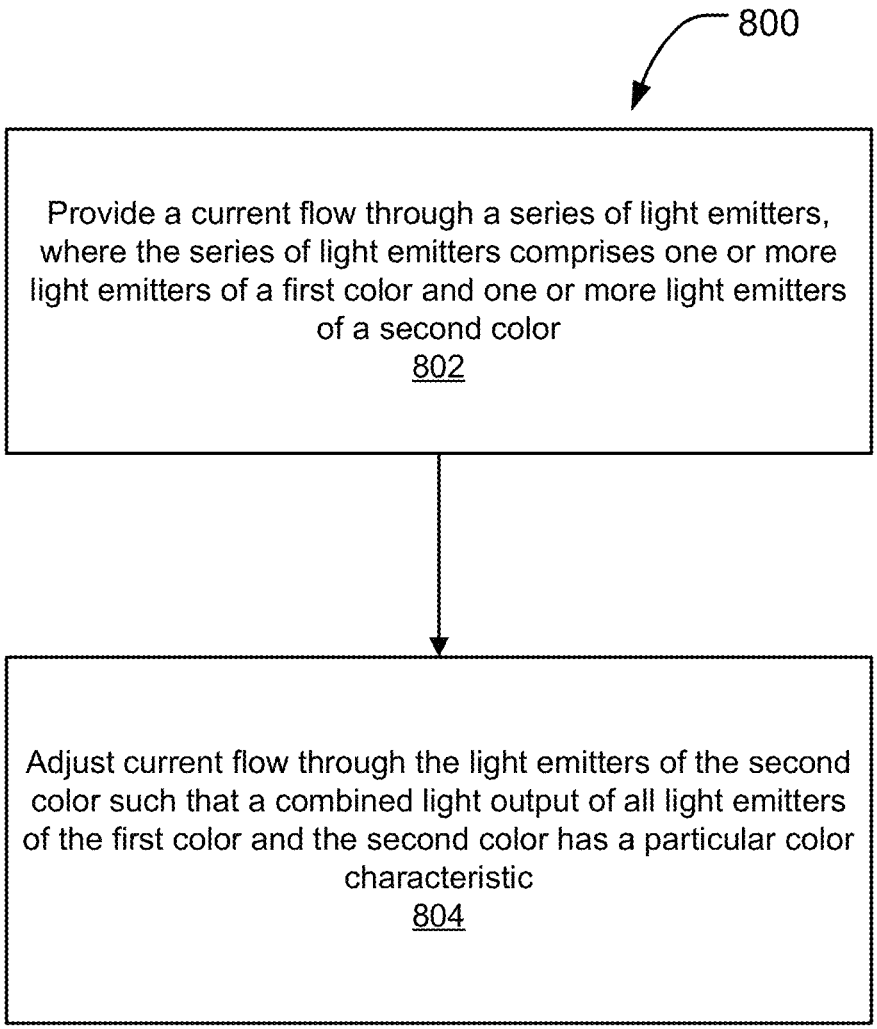
FIG. 8 shows a process diagram of a set of exemplary operations to produce light output with a particular characteristic in accordance with an exemplary embodiment.

FIG. 8 shows a process diagram 800 of a set of exemplary operations to produce light output with a particular characteristic in accordance with an exemplary embodiment. The process includes an operation 802 to provide a current flow through a series of light emitters, in which the series of light emitters includes one or more light emitters of a first color and one or more light emitters of a second color. In some examples, the series of light emitters includes additional color groups. The process includes an operation 802 to adjust current flow through the light emitters of the second color such that a combined light output of all light emitters of the first color and the second color have a particular color characteristic. In one exemplary embodiment, the particular color characteristic includes one or more of a particular color index, a range of color values in a CIE color space, a color intensity value and a color temperature value.

In some exemplary implementations, a solid-state lighting module is provided, in which one group of solid-state light emitters (e.g., LEDs) has a blue color (e.g., dominant wavelength from 435 to 485 nm), one group of luminescent LEDs has a yellow color (e.g., dominant wavelength from 550 to 585 nm), and one group of LEDs has a red color (e.g., dominant wavelength from 610 to 640 nm). In another example, a solid-state lighting module is provided, in which one group of solid-state light emitters (e.g., LEDs) has a green color (e.g., dominant wavelength from 515 to 540 nm), one group of luminescent LEDs has a yellow color (e.g., dominant wavelength from 550 to 585 nm), and one group of LEDs has a red color (e.g., dominant wavelength from 610 to 640 nm). In another example, a solid-state lighting module is provided, in which one group of solid-state light emitters (e.g., LEDs) has a blue color (e.g., dominant wavelength from 435 to 485 nm), one group of solid-state light emitters (e.g., LEDs) has a green color (e.g., dominant wavelength from 515 to 540 nm), one group of luminescent LEDs has a yellow color (e.g., dominant wavelength from 550 to 585 nm), and a group of LEDs that have a color of red (e.g., dominant wavelength from 610 to 640 nm). In the above examples, the yellow luminescent LEDs can be made of a yellow luminescent material (e.g., such as, but not limited to, phosphors or quantum dots) excited by a blue or UV LED.

In some exemplary implementations, the LED intensity is adjusted using an on-off modulation technique, e.g., in which the duration (or duty cycle) of the on- and off-times of the LED or the driving current is adjusted according a pre-recorded data map for each color group.

The disclosed embodiments enable the production of an output light in a light source module that can be tuned to provide a particular intensity and color. Such output light characteristics can be maintained across different batches of light source modules that can include individual light emitters with varying characteristics. During manufacturing and/or at the quality testing stage of light module production, each light module can be tested and adjusted independently, in accordance with the disclosed embodiments, to produce an output light that is consistent (or uniform) across all other manufactured light sources. The individual adjustment and/or calibration of each light module further allows the output of each light module to be calibrated by taking into account variations due to temperature and/or age of the components within the module. Moreover, the programmability of adjustment parameters/coefficients that is described, for example, in connection with the exemplary light source module 600 in FIG. 6, enables modification of output light characteristics after manufacturing. For example, the light modules may be further calibrated at user premises as the components within the light module age, or as these components are subjected to temperature variations of the particular installed premises.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described, and other implementations, enhancements and variations can be made based on what is described and illustrated in this patent document.

What is claimed is:

1. A light source module, comprising:

one or more light emitters of a first color forming a first color group;

one or more light emitters of a second color forming a second color group, the one or more light emitters of the second color group connected in series with the one or more light emitters of the first color group;

a second color group adjustment circuit connected in parallel with the one or more light emitters of the second color group, the second color group adjustment circuit configured to adjust color, to adjust intensity of output light, or to adjust color and intensity of output light of the second color group; and a current source connected in series with solid-state color emitters of the first and the second color groups, wherein the second color group adjustment circuit includes a feedback mechanism configured to simultaneously provide adjusted non-zero currents to flow through the one or more light emitters of the second color group and the second color group adjustment circuit, wherein a first sensing resistor is in series with the second color group and a second sensing resistor is in series with the second color group adjustment circuit and wherein the feedback mechanism senses currents at outputs of the first sensing resistor and the second sensing resistor.

2. The light source module of claim 1, wherein the one or more light emitters of the first color and the one or more light emitters of the second color are light emitting diodes (LEDs).

3. The light source module of claim 1, wherein the one or more light emitters of the first color and the one or more light emitters of the second color are laser diodes.

4. The light source module of claim 1, wherein the first color group is a yellow color group and the second color group is one of a red color group or a blue color group.

5. The light source module of claim 1, wherein the feedback mechanism is configured to control a ratio of the current that flows through the one or more light emitters of the second color group to the current that flows through the second color adjustment circuit.

6. The light source module of claim 1, wherein the second color adjustment circuit includes a programmable module to provide a current sink, the programmable module including:

an analog-to-digital converter (ADC) to convert an analog signal associated with the current to a digital signal, a programmable microcontroller or CPU to process data corresponding to the digital signal to determine an adjusted current to flow through the one or more light emitters of the second color group, a memory unit coupled to the programmable microcontroller or CPU to store at least one of processing algorithms or look-up table data, and one or both of a digital-to-analog converter (DAC) and a pulse width modulation (PWM) output component to provide the adjusted current.

7. The light source module of claim 1, further comprising:

one or more light emitters of a third color forming a third color group, the one or more light emitters of the third color group connected in series with the one or more light emitters of the second color group; and a third color group adjustment circuit connected in parallel with the one or more light emitters of the third color group, the third color group adjustment circuit configured to adjust color, to adjust intensity of output light, or to adjust color and intensity of output light of the third color group.

8. The light source module of claim 7, wherein the first color group is a yellow color group, the second color group is a red color group, and the third color group is a blue color group.

9. The light source module of claim 7, wherein the second color adjustment circuit is configured to adjust the current that flows through the one or more light emitters of the second color group.

10. The light source module of claim 7, wherein the second color adjustment circuit is configured to adjust the current that flows through the one or more light emitters of the second color group, and the third color adjustment circuit is configured to adjust the current that flows through the one or more light emitters of the third color group.

11. The light source module of claim 10, wherein the second color adjustment circuit includes a feedback mechanism to control a ratio of the current that flows through the one or more light emitters of the second color group to the current that flows through the second color adjustment circuit, and the third color adjustment circuit includes a feedback mechanism to control a ratio of the current that flows through the one or more light emitters of the third color group to the current that flows through the third color adjustment circuit.

12. The light source module of claim 10, wherein at least one of the second color adjustment circuit or the third color adjustment circuit includes a programmable module to provide a current sink, the programmable module including:

an ADC to convert an analog signal associated with the current to a digital signal, a programmable microcontroller or CPU to process data corresponding to the digital signal to determine an adjusted current to flow through the one or more light emitters of the corresponding color group, a memory unit coupled to the programmable microcontroller or CPU to store at least one of processing algorithms or look-up table data, and one or both of a DAC and a PWM output component to provide the adjusted current.

13. The light source module of claim 12, wherein the programmable module further includes an interface port to provide connectivity to enable the capability to provide one or more of data, signaling information, or program code for storage in the memory unit.

14. The light source module of claim 12, wherein the programmable module operates using power supplied by the current source.

15. The light source module of claim 1, wherein the second color adjustment circuit includes one or more sensors configured to sense one or more of temperature, color value or intensity of light emitted by the second color group.

16. The light source module of claim 7, wherein the third color adjustment circuit includes one or more sensors configured to sense one or more of temperature, color value or intensity of light emitted by the third color group.

17. A method for producing a light of a particular color at an output of a light source module, comprising:

providing a current flow through a series of light emitters, wherein the series of light emitters comprises one or more light emitters of a first color and one or more light emitters of a second color; and adjusting current flow through the light emitters of the second color, wherein adjusting the current flow is carried out by one or more iterations of:

measuring light output of the light source module, and adjusting, based on the measured light output, a current flow through a second color adjustment circuit that is connected in parallel with the light emitters of the second color, wherein adjusted non-zero currents respectively flow through the light emitters of the second color and the color adjustment circuit to provide a combined light output of all light emitters of the first color and the second color with a particular color characteristic, wherein a first sensing resistor is in series with the second color group and a second sensing resistor is in series with the second color group adjustment circuit and wherein the feedback mechanism senses currents at outputs of the first sensing resistor and the second sensing resistor.

18. The method of claim 17, wherein the particular color characteristic includes one or more of a particular color index, a range of color values in a CIE color space, a color intensity value, or a color temperature value.

19. The method of claim 17, wherein the series of light emitters includes one or more additional light emitters corresponding to one or more additional colors.

20. The method of claim 19, wherein a particular color characteristic associated with all light emitters of the first color, the second color, and the additional colors is obtained by additionally adjusting current flow through the one or more additional light emitters.

* * * * *